US009232595B2

(12) United States Patent
Dan

(10) Patent No.: US 9,232,595 B2
(45) Date of Patent: Jan. 5, 2016

(54) BACKLIGHT DRIVING CIRCUIT AND LIQUID CRYSTAL DISPLAY DEVICE

(71) Applicant: SHENZHEN CHINA STAR OPTOELECTRONICS TECHNOLOGY CO., LTD, Shenzhen (CN)

(72) Inventor: Cao Dan, Shenzhen (CN)

(73) Assignee: SHENZHEN CHINA STAR OPTOELECTRONICS TECHNOLOGY CO. LTD., Shenzhen (CN)

( * ) Notice: Subject to any disclaimer, the term of this patent is extended or adjusted under 35 U.S.C. 154(b) by 0 days.

(21) Appl. No.: 14/233,765

(22) PCT Filed: Nov. 4, 2013

(86) PCT No.: PCT/CN2013/086493

§ 371 (c)(1),
(2) Date: Jan. 20, 2014

(87) PCT Pub. No.: WO2015/058423

PCT Pub. Date: Apr. 30, 2015

(65) Prior Publication Data

US 2015/0195881 A1 Jul. 9, 2015

(30) Foreign Application Priority Data

Oct. 25, 2013 (CN) ..... 2013 1 0509043

(51) Int. Cl.
*H05B 37/02* (2006.01)
*H05B 33/08* (2006.01)
*G09G 3/34* (2006.01)

(52) U.S. Cl.
CPC ..... *H05B 33/0845* (2013.01); *G09G 3/3406* (2013.01); *G09G 3/3426* (2013.01); *H05B 33/0815* (2013.01); *H05B 37/02* (2013.01); *G09G 2310/068* (2013.01)

(58) Field of Classification Search
CPC . H05B 33/0815; H05B 33/0845; H05B 37/02
USPC ..... 315/185 R, 192, 224, 291, 297, 307, 308
See application file for complete search history.

(56) References Cited

U.S. PATENT DOCUMENTS

2009/0230873 A1 9/2009 Wu et al.
2009/0302776 A1 * 12/2009 Szczeszynski ..... 315/246

(Continued)

FOREIGN PATENT DOCUMENTS

CN 101533607 A 9/2009
CN 102136252 A 7/2011

(Continued)

*Primary Examiner* — Tung X Le
(74) *Attorney, Agent, or Firm* — Mark M. Friedman

(57) ABSTRACT

A backlight driving circuit and a liquid crystal display device are disclosed. The backlight driving circuit is utilized for driving at least one light emitting diode bar and includes a power supply module, a conversion module, a comparison module, and a control module. The power supply module provides a driving current for the light emitting diode bar. The conversion module generates a conversion voltage according to the driving current. The comparison module compares the conversion voltage with a reference voltage. The control module controls whether the power supply module provides the driving current for the light emitting diode bar according to whether the conversion voltage is greater than the reference voltage. The backlight driving circuit and the liquid crystal display device of the present invention can limit the driving current flowing through the light emitting diode bar.

9 Claims, 2 Drawing Sheets

(56) References Cited

U.S. PATENT DOCUMENTS

| | | | | |
|---|---|---|---|---|
| 2011/0037410 | A1* | 2/2011 | Hsu | H05B 33/0827 315/294 |
| 2011/0181625 | A1 | 7/2011 | Shin et al. | |
| 2011/0273104 | A1 | 11/2011 | Uchimoto et al. | |
| 2012/0074856 | A1* | 3/2012 | Takata | H05B 33/0815 315/192 |
| 2013/0026926 | A1* | 1/2013 | Oh et al. | 315/122 |
| 2014/0139110 | A1 | 5/2014 | Hu et al. | |

FOREIGN PATENT DOCUMENTS

| | | | |
|---|---|---|---|
| CN | 102842893 | A | 12/2012 |
| CN | 103021343 | A | 4/2013 |
| JP | 2008116653 | A | 5/2008 |
| KR | 1020110118573 | A | 10/2011 |

* cited by examiner

BACKLIGHT DRIVING CIRCUIT AND LIQUID CRYSTAL DISPLAY DEVICE

BACKGROUND OF THE INVENTION

1. Field of the Invention

The present invention generally relates to a driving circuit, and more particularly to a backlight driving circuit and a liquid crystal display device having the backlight driving circuit.

2. Description of Prior Art

A liquid crystal display device mainly comprises a liquid crystal panel and a backlight module. The backlight module is utilized for providing light when the liquid crystal panel displays an image. Light emitting diodes (LEDs) are utilized as a light source in the conventional backlight module. More particularly, a conventional light source comprises a plurality of light emitting diode bars which are electrically coupled in parallel. Each of the light emitting diode bars comprises a plurality of light emitting diodes which are electrically coupled in series.

In the above-mentioned conventional backlight module, a backlight driving circuit provides a required driving current for driving all of the light emitting diode bars. However, the driving current flowing through the light emitting diode bars cannot be limited by the conventional backlight driving circuit. When a false condition occurs and the driving current is too high, the light emitting diode bars and the backlight driving circuit are destroyed by the high driving current.

Consequently, there is a need to solve the problem that the light emitting diode bars and the backlight driving circuit are destroyed by the high driving current resulted from the false condition because the driving current flowing through the light emitting diode bars cannot be limited in the prior arts.

SUMMARY OF THE INVENTION

An objective of the present invention is to provide a backlight driving circuit and a liquid crystal display device capable of limiting a driving current flowing through at least one light emitting diode bar.

To solve the above-mentioned problem, a backlight driving circuit provided by the present invention is utilized for driving at least one light emitting diode bar. The backlight driving circuit comprises a power supply module, a conversion module, a comparison module, and a control module. The power supply module is utilized for providing a driving current for the light emitting diode bar. The conversion module is electrically coupled to the power supply module for generating a conversion voltage according to the driving current. The comparison module is electrically coupled to the conversion module for comparing the conversion voltage with a reference voltage. The control module is electrically coupled to the power supply module, the comparison module, and the light emitting diode bar. When the conversion voltage is greater than the reference voltage, the control module controls the power supply module to stop providing the driving current for the light emitting diode bar. When the conversion voltage is smaller than the reference voltage, the control module controls the power supply module to provide the driving current for the light emitting diode bar.

In the backlight driving circuit of the present invention, the conversion module comprises a photo coupler and a first resistor. The photo coupler comprises a light emitting element and a switch element. The light emitting element is electrically coupled between the power supply module and a positive polarity end of the light emitting diode bar for transmitting the driving current. The first resistor has a first end and a second end. The switch element is electrically coupled between a voltage source and the first end of the first resistor for outputting a switch current according to a light intensity of the light emitting element. The conversion voltage is obtained by multiplying the switch current by a resistance value of the first resistor.

In the backlight driving circuit of the present invention, the comparison module comprises an operational amplifier and a first N-type metal-oxide-semiconductor transistor. The operational amplifier comprises a non-inverting input, an inverting input, and an output. The non-inverting input is electrically coupled to the conversion voltage, and the inverting input is electrically coupled to the reference voltage. The output of the operational amplifier is electrically coupled to a gate of the first N-type metal-oxide-semiconductor transistor. A source of the first N-type metal-oxide-semiconductor transistor is electrically coupled to a ground end. When the conversion voltage is greater than the reference voltage, the output of the operational amplifier is at a high level, the first N-type metal-oxide-semiconductor transistor is turned on, and a drain of the first the N-type metal-oxide-semiconductor transistor is changed to a low level. When the conversion voltage is smaller than the reference voltage, the output of the operational amplifier is at a low level, the first N-type metal-oxide-semiconductor transistor is turned off, and the drain of the first N-type metal-oxide-semiconductor transistor is changed to a high level.

In the backlight driving circuit of the present invention, the control module comprises a control unit and a second N-type metal-oxide-semiconductor transistor. The control unit has an enable pin and a plurality of control pins. The enable pin is electrically coupled to the drain of the first N-type metal-oxide-semiconductor transistor. The second N-type metal-oxide-semiconductor transistor is electrically coupled to the control unit. When the drain of the first N-type metal-oxide-semiconductor transistor is changed to the low level, the control unit controls the power supply module to stop providing the driving current for the light emitting diode bar via the second N-type metal-oxide-semiconductor transistor. When the drain of the first N-type metal-oxide-semiconductor transistor is changed to the high level, the control unit controls the power supply module to provide the driving current for the light emitting diode bar via the second N-type metal-oxide-semiconductor transistor.

To solve the above-mentioned problem, a backlight driving circuit provided by the present invention is utilized for driving at least one light emitting diode bar. The backlight driving circuit comprises a power supply module, a conversion module, a comparison module, and a control module. The power supply module is utilized for providing a driving current for the light emitting diode bar. The conversion module is electrically coupled to the power supply module for generating a conversion voltage according to the driving current. The comparison module is electrically coupled to the conversion module for comparing the conversion voltage with a reference voltage. The control module is electrically coupled to the power supply module, the comparison module, and the light emitting diode bar for controlling whether the power supply module provides the driving current for the light emitting diode bar according to whether the conversion voltage is greater than the reference voltage.

In the backlight driving circuit of the present invention, when the conversion voltage is greater than the reference voltage, the control module controls the power supply module to stop providing the driving current for the light emitting diode bar.

In the backlight driving circuit of the present invention, when the conversion voltage is smaller than the reference voltage, the control module controls the power supply module to provide the driving current for the light emitting diode bar.

In the backlight driving circuit of the present invention, the conversion module comprises a photo coupler and a first resistor. The photo coupler comprises a light emitting element and a switch element. The light emitting element is electrically coupled between the power supply module and a positive polarity end of the light emitting diode bar for transmitting the driving current. The first resistor has a first end and a second end. The switch element is electrically coupled between a voltage source and the first end of the first resistor for outputting a switch current according to a light intensity of the light emitting element, and the conversion voltage is obtained by multiplying the switch current by a resistance value of the first resistor.

In the backlight driving circuit of the present invention, the comparison module comprises an operational amplifier and a first N-type metal-oxide-semiconductor transistor. The operational amplifier comprises a non-inverting input, an inverting input, and an output. The non-inverting input is electrically coupled to the conversion voltage, and the inverting input electrically coupled to the reference voltage. The output of the operational amplifier is electrically coupled to a gate of the first N-type metal-oxide-semiconductor transistor. A source of the first N-type metal-oxide-semiconductor transistor is electrically coupled to a ground end. When the conversion voltage is greater than the reference voltage, the output of the operational amplifier is at a high level, the first N-type metal-oxide-semiconductor transistor is turned on, and a drain of the first the N-type metal-oxide-semiconductor transistor is changed to a low level. When the conversion voltage is smaller than the reference voltage, the output of the operational amplifier is at a low level, the first N-type metal-oxide-semiconductor transistor is turned off, and the drain of the first N-type metal-oxide-semiconductor transistor is changed to a high level.

In the backlight driving circuit of the present invention, the control module comprises a control unit and a second N-type metal-oxide-semiconductor transistor. The control unit has an enable pin and a plurality of control pins. The enable pin is electrically coupled to the drain of the first N-type metal-oxide-semiconductor transistor. The second N-type metal-oxide-semiconductor transistor is electrically coupled to the control unit. When the drain of the first N-type metal-oxide-semiconductor transistor is changed to the low level, the control unit controls the power supply module to stop providing the driving current for the light emitting diode bar via the second N-type metal-oxide-semiconductor transistor. When the drain of the first N-type metal-oxide-semiconductor transistor is changed to the high level, the control unit controls the power supply module to provide the driving current for the light emitting diode bar via the second N-type metal-oxide-semiconductor transistor.

The present invention further provides a liquid crystal display device comprising the above-mentioned backlight driving circuit.

Compared with the prior arts, the backlight driving circuit and the liquid crystal display device of the present invention are capable of limiting the driving current flowing through the light emitting diode bar. When the driving current is greater than a preset maximum value, the control module can control the power supply module to stop providing the driving current.

For a better understanding of the aforementioned content of the present invention, preferable embodiments are illustrated in accordance with the attached figures for further explanation:

DETAILED DESCRIPTION OF THE INVENTION

The following descriptions for the respective embodiments are specific embodiments capable of being implemented for illustrations of the present invention with referring to appended figures.

Figure 1:
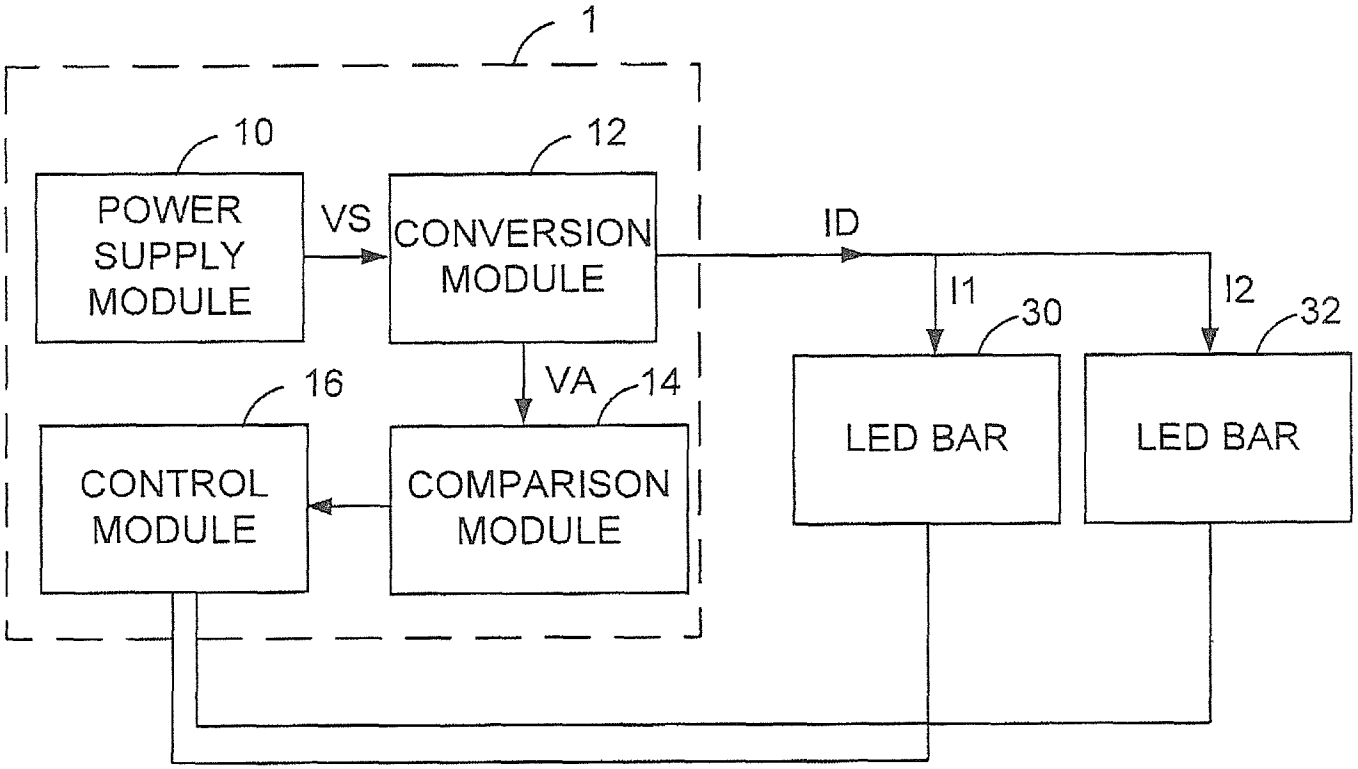
FIG. 1 illustrates a block diagram of a backlight driving circuit in accordance with an embodiment of the present invention.

Please refer to FIG. 1. FIG. 1 illustrates a block diagram of a backlight driving circuit 1 in accordance with an embodiment of the present invention.

The backlight driving circuit 1 is utilized for driving at least one light emitting diode (LED) bar (two LED bars 30, 32 are shown in FIG. 1). The backlight driving circuit 1 comprises a power supply module 10, a conversion module 12, a comparison module 14, and a control module 16.

The power supply module 10 is utilized for outputting a power supply voltage VS for providing a driving current ID for the LED bars 30 and 32. The power supply module 10 is further utilized for providing power for the control module 16.

The conversion module 12 is electrically coupled to the power supply module 10 for generating a conversion voltage VA according to the driving current ID.

Figure 2:
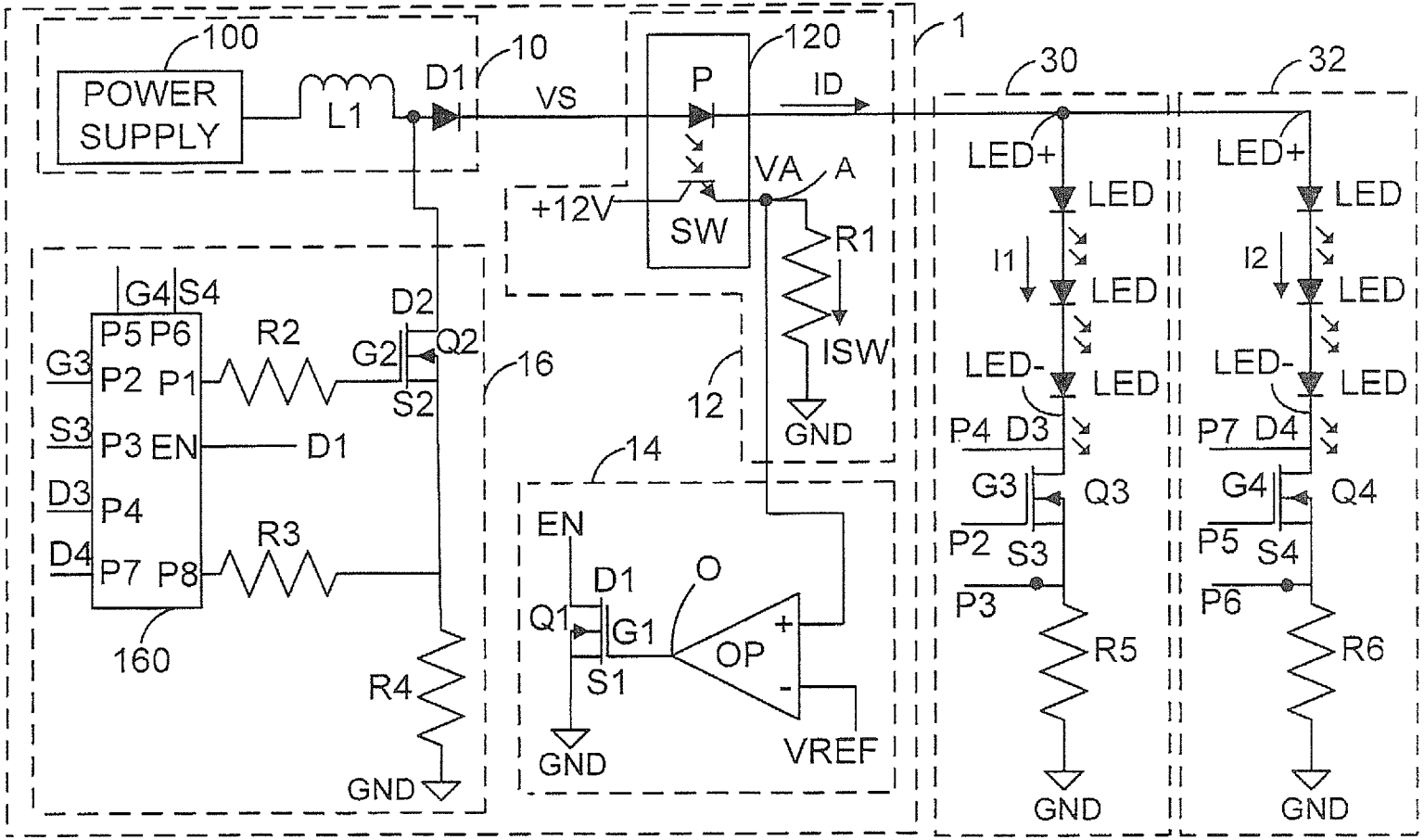
FIG. 2 illustrates detailed circuits of the backlight driving circuit and the LED bars in FIG. 1.

The comparison module 14 is electrically coupled to the conversion module 12 for comparing the conversion voltage VA with a reference voltage VREF (as shown in FIG. 2).

The control module 16 is electrically coupled to the power supply module 10, the comparison module 14, and the LED bars 30 and 32 for controlling whether the power supply module 10 provides the driving current ID for the LED bars 30 and 32 according to whether the conversion voltage VA is greater than the reference voltage VREF (as shown in FIG. 2).

When the conversion voltage VA is greater than the reference voltage VREF, the control module 16 controls the power supply module 10 to stop providing the driving current ID for the LED bars 30 and 32.

When the conversion voltage VA is smaller than the reference voltage VREF, the control module 16 controls the power supply module 10 to provide the driving current ID for the LED bars 30 and 32.

Furthermore, the control module may further control the LED bars 30 and 32.

Please refer to FIG. 1 and FIG. 2. FIG. 2 illustrates detailed circuits of the backlight driving circuit 1 and the LED bars 30 and 32 in FIG. 1.

The power supply module 10 comprises a power supply 100, a coil L1, and a diode D1. A first end of the coil L1 is electrically coupled to the power supply 100, and a second end of the coil L1 is electrically coupled to an anode of the diode D1. The coil L1 is utilized for converting a voltage of the power supply 100 to the power supply voltage VS which is suitable for the conversion module 12 and the control module 16. A cathode of the diode D1 is electrically coupled to the conversion module 12 for preventing a reverse current.

It is noted that the coil L1 is an optional element. When the power supply 100 can provide the power supply voltage VS suitable for the conversion module 12 and the control module 16, the coil L1 may be omitted.

The conversion module 12 comprises a photo coupler 120 and a first resistor R1. The first resistor R1 has a first end and a second end. The photo coupler 120 comprises a light emitting element P and a switch element SW. The light emitting element P is electrically coupled to the power supply module 10 and positive polarity ends LED+ of the LED bars 30 and 32 for transmitting the driving current ID. The switch element SW is electrically coupled between a voltage source (e.g. +12V) and the first end of the first resistor R1 for outputting a switch current ISW according to a light intensity of the light emitting element P. The second end of the first resistor R1 is electrically coupled to a ground end GND.

The comparison module 14 comprises an operational amplifier OP and a first N-type metal-oxide-semiconductor (N-MOS) transistor Q1. The operational amplifier OP comprises a non-inverting input +, an inverting input −, and an output O. The non-inverting input + is electrically coupled to the first end of the first resistor R1, that is, electrically coupled to the conversion voltage VA. The inverting input − is electrically coupled to the reference voltage VREF. The output O is electrically coupled to a gate G1 of the first N-MOS transistor Q1. A source S1 of the first N-MOS transistor Q1 is electrically coupled to the ground end GND.

The control module 16 comprises a control unit 160, a second resistor R2, a third resistor R3, a fourth resistor R4, and a second N-MOS transistor Q2. In the present embodiment, the control unit 160 is an integrated circuit (IC) and has an enable pin EN and a plurality of control pins P1-P8. A first end of the second resistor R2 is electrically coupled to the control pin P1, and a second end of the second resistor R2 is electrically coupled to a gate G2 of the second N-MOS transistor Q2. A first end of the third resistor R3 is electrically coupled to the control pin P8, and a second end of the third resistor R3 is electrically coupled to a source S2 of the second N-MOS transistor Q2. A first end of the fourth resistor R4 is electrically coupled to the source S2 of the second N-MOS transistor Q2, and a second end of the fourth resistor R4 is electrically coupled to the ground end GND. A drain of the second N-MOS transistor Q2 is electrically coupled to the anode of the diode D1. The enable pin EN is electrically coupled to a drain D1 of the first N-MOS transistor Q1. When the enable pin EN is at a high level, the control unit 160 is enabled and thus can work normally. That is, the control unit 160 controls the power supply module 10 to provide the driving current ID for the LED bars 30 and 32. When the enable pin EN is at a low level, the control unit 160 is disabled and thus stops working. That is, the control unit 160 controls the power supply module 10 to stop providing the driving current ID for the LED bars 30 and 32. The control pins P2-P7 will be described in detail later.

There are two LED bars 30 and 32 in the embodiment in FIG. 2. In another embodiment, a number of the LED bars is not limited.

The two LED bars 30 and 32 are electrically coupled in parallel. Each of the LED bars 30 and 32 comprises a plurality of light emitting diodes LED which are electrically coupled in series. The light emitting diodes LED which are electrically coupled in series have the positive polarity end LED+ and a negative polarity end LED−. Each of the light emitting diodes LED has an anode and a cathode. In the LED bar 30, an anode of a first light emitting diode LED is electrically coupled to the cathode of the light emitting element P. That is, the positive polarity end LED+ of the LED bar 30 is electrically coupled to the cathode of the light emitting element P. A cathode of a last light emitting diode LED is electrically coupled to a drain D3 of a third N-MOS transistor Q3. That is, the negative polarity end LED− of the LED bar 30 is electrically coupled to the drain D3 of the third N-MOS transistor Q3. A gate G3, a source S3, and the drain D3 of the third N-MOS transistor Q3 are respectively electrically coupled to the control pins P2-P4 of the control unit 160.

Similarly, in the LED bar 32, an anode of a first light emitting diode LED is electrically coupled to the cathode of the light emitting element P. That is, the positive polarity end LED+ of the LED bar 32 is electrically coupled to the cathode of the light emitting element P. A cathode of a last light emitting diode LED is electrically coupled to a drain D4 of a fourth N-MOS transistor Q4. That is, the negative polarity end LED− of the LED bar 32 is electrically coupled to the drain D4 of the fourth N-MOS transistor Q4. A gate G4, a source S4, and the drain D4 of the fourth N-MOS transistor Q4 are respectively electrically coupled to the control pins P5-P7 of the control unit 160.

It can be understood from mentioned above that the control unit 160 may be utilized for control turn-on states and turn-off states of the third N-MOS transistors Q3 and the fourth N-MOS transistors Q4.

An operational principle of the backlight driving circuit 1 will be described in detail as follows.

The driving current ID flowing through the light emitting element P is equal to a sum of a current I1 flowing through the LED bar 30 and a current I2 flowing through the LED bar 32. According to characteristics of the photo coupler 120, the driving current ID is equal to $\beta \times ISW$. $\beta$ is an inverse of a current transfer ratio (CTR). The current transfer ratio is equal to ISW/ID. The switch current ISW is the current flowing through the switch SW. A maximum value of the switch current ISW is equal to VREF/R4. Accordingly, a maximum value of the driving current ID flowing through the light emitting element P is equal to $\beta \times VREF/R4$. In order to achieve an objective of protecting the backlight driving circuit 1 and the LED bars 30 and 32, the driving current ID flowing through the light emitting element P can be limited by presetting a resistance value of the fourth resistor R4 and a value of the reference voltage VREF.

When the driving current ID flowing through the light emitting element P is greater than $\beta \times VREF/R4$, the conversion voltage VA at a node A is greater than the reference voltage VREF. The output O of the operational amplifier OP is at a high level, and the first N-MOS transistor Q1 is turned on. Then, the drain D1 of the first N-MOS transistor Q1 is changed to a low level, and the low level makes the control unit 160 stop working (i.e. the control unit 160 is disabled), thereby achieving the objective of protecting the backlight driving circuit 1 and the LED bars 30 and 32. More particularly, the control unit 160 controls the second N-MOS transistor Q2 to be turned off via the control pins P1 and P8, thereby making the power supply module 10 stop providing the driving current ID for the LED bars 30 and 32.

When the driving current ID flowing through the light emitting element P is smaller than $\beta \times VREF/R4$, the conversion voltage VA at the node A is smaller than the reference voltage VREF. The output O of the operational amplifier OP is at a low level, and the first N-MOS transistor Q1 is turned off. Then, the drain D1 of the first N-MOS transistor Q1 is changed to a high level, and the high level makes the control unit 160 work normally (i.e. the control unit 160 is enabled). More particularly, the control unit 160 controls the second N-MOS transistor Q2 to be turned on via the control pins P1 and P8, thereby making the power supply module 10 provide the driving current ID for the LED bars 30 and 32.

Furthermore, the control unit 160 is capable of controlling the turn-on state and the turn-off state of the third N-MOS transistor Q3 of the LED bar 30 via the control pins P2-P4, thereby controlling the operations of the LED bar 30. The control unit 160 is capable of controlling the turn-on state and the turn-off state of the fourth N-MOS transistor Q4 of the LED bar 32 via the control pins P5-P7, thereby controlling the operations of the LED bar 32.

In another embodiment, P-type MOS (P-MOS) transistors may be substituted for the N-MOS transistors Q1-Q4.

Furthermore, the present invention further provides a liquid crystal display device, and the liquid crystal display device comprises the above-mentioned backlight driving circuit 1.

The backlight driving circuit and the liquid crystal display device of the present invention are capable of limiting the driving current flowing through the LED bars. When the driving current is greater than a preset maximum value, the control module can control the power supply module to stop providing the driving current.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A backlight driving circuit, utilized for driving at least one light emitting diode bar, the backlight driving circuit comprising:

a power supply nodule for providing a driving current for the light emitting diode bar;

a conversion module electrically coupled to the power supply module for generating a conversion voltage according to the driving current;

a comparison module electrically coupled to the conversion module for comparing the conversion voltage with a reference voltage; and a control module electrically coupled to the power supply module, the comparison module, and the light emitting diode bar, wherein when the conversion voltage is greater than the reference voltage, the control module controls the power supply module to stop providing the driving current for the light emitting diode bar, when the conversion voltage is smaller than the reference voltage, the control module controls the power supply module to provide the driving current for the light emitting diode bar;

wherein the conversion module comprises:

a photo coupler comprising a light emitting element and a switch element, the light emitting element being electrically coupled between the power supply module and a positive polarity end of the light emitting diode bar for transmitting the driving current; and a first resistor having a first end and a second end, wherein the switch element is electrically coupled between a voltage source and the first end of the first resistor for outputting a switch current according to a light intensity of the light emitting element, and the conversion voltage is obtained by multiplying the switch current by a resistance value of the first resistor.

2. The backlight driving circuit of claim 1, wherein the comparison module comprises:

an operational amplifier comprising a non-inverting input, an inverting input, and an output, the non-inverting input electrically coupled to the conversion voltage, and the inverting input electrically coupled to the reference voltage; and a first N-type metal-oxide-semiconductor transistor, the output of the operational amplifier electrically coupled to a gate of the first N-type metal-oxide-semiconductor transistor, and a source of the first N-type metal-oxide-semiconductor transistor electrically coupled to a ground end, wherein when the conversion voltage is greater than the reference voltage, the output of the operational amplifier is at a high level, the first N-type metal-oxide-semiconductor transistor is turned on, and a drain of the first the N-type metal-oxide-semiconductor transistor is changed to a low level, when the conversion voltage is smaller than the reference voltage, the output of the operational amplifier is at a low level, the first N-type metal-oxide-semiconductor transistor is turned off, and the drain of the first N-type metal-oxide-semiconductor transistor is changed to a high level.

3. The backlight driving circuit of claim 2, wherein the control module comprises:

a control unit having an enable pin and a plurality of control pins, the enable pin electrically coupled to the drain of the first N-type metal-oxide-semiconductor transistor; and a second N-type metal-oxide-semiconductor transistor electrically coupled to the control unit, wherein when the drain of the first N-type metal-oxide-semiconductor transistor is changed to the low level, the control unit controls the power supply module to stop providing the driving current for the light emitting diode bar via the second N-type metal-oxide-semiconductor transistor, when the drain of the first N-type metal-oxide-semiconductor transistor is changed to the high level, the control unit controls the power supply module to provide the driving current for the light emitting diode bar via the second N-type metal-oxide-semiconductor transistor.

4. A backlight driving circuit, utilized for driving at least one light emitting diode bar, the backlight driving circuit comprising:

a power supply module for providing a driving current for the light emitting diode bar;

a conversion module electrically coupled to the power supply module for generating a conversion voltage according to the driving current;

a comparison module electrically coupled to the conversion module for comparing the conversion voltage with a reference voltage; and a control module electrically coupled to the power supply module, the comparison module, and the light emitting diode bar for controlling whether the power supply module provides the driving current for the light emitting diode bar according to whether the conversion voltage is greater than the reference voltage;

wherein the conversion module comprises:

a photo coupler comprising a light emitting element and a switch element, the light emitting element being electrically coupled between the power supply module and a positive polarity end of the light emitting diode bar for transmitting the driving current; and a first resistor having a first end and a second end, wherein the switch element is electrically coupled between a voltage source and the first end of the first resistor for outputting a switch current according to a light intensity of the light emitting element, and the conversion voltage is obtained by multiplying the switch current by a resistance value of the first resistor.

5. The backlight driving circuit of claim 4, wherein when the conversion voltage is greater than the reference voltage, the control module controls the power supply module to stop providing the driving current for the light emitting diode bar.

6. The backlight driving circuit of claim 4, wherein when the conversion voltage is smaller than the reference voltage, the control module controls the power supply module to provide the driving current for the light emitting diode bar.

7. The backlight driving circuit of claim 4, wherein the comparison module comprises:

an operational amplifier comprising a non-inverting input, an inverting input, and an output, the non-inverting input electrically coupled to the conversion voltage, and the inverting input electrically coupled to the reference voltage; and a first N-type metal-oxide-semiconductor transistor, the output of the operational amplifier electrically coupled to a gate of the first N-type metal-oxide-semiconductor transistor, a source of the first N-type metal-oxide-semiconductor transistor electrically coupled to a ground end, wherein when the conversion voltage is greater than the reference voltage, the output of the operational amplifier is at a high level, the first N-type metal-oxide-semiconductor transistor is turned on, and a drain of the first the N-type metal-oxide-semiconductor transistor is changed to a low level, when the conversion voltage is smaller than the reference voltage, the output of the operational amplifier is at a low level, the first N-type metal-oxide-semiconductor transistor is turned off, and the drain of the first N-type metal-oxide-semiconductor transistor is changed to a high level.

8. The backlight driving circuit of claim 7, wherein the control module comprises:

a control unit having an enable pin and a plurality of control pins, the enable pin electrically coupled to the drain of the first N-type metal-oxide-semiconductor transistor; and a second N-type metal-oxide-semiconductor transistor electrically coupled to the control unit, wherein when the drain of the first N-type metal-oxide-semiconductor transistor is changed to the low level, the control unit controls the power supply module to stop providing the driving current for the light emitting diode bar via the second N-type metal-oxide-semiconductor transistor, when the drain of the first N-type metal-oxide-semiconductor transistor is changed to the high level, the control unit controls the power supply module to provide the driving current for the light emitting diode bar via the second N-type metal-oxide-semiconductor transistor.

9. A liquid crystal display device comprising the backlight driving circuit of claim 4.

* * * * *

UNITED STATES PATENT AND TRADEMARK OFFICE

CERTIFICATE OF CORRECTION

PATENT NO. : 9,232,595 B2
APPLICATION NO. : 14/233765
DATED : January 5, 2016
INVENTOR(S) : Cao Dan It is certified that error appears in the above-identified patent and that said Letters Patent is hereby corrected as shown below:

In the claims:

Claim 1 column 7 line 36 should be corrected as follows:
Change
-- nodule --
to
"module"

Signed and Sealed this
Twelfth Day of April, 2016

Michelle K. Lee

Michelle K. Lee
*Director of the United States Patent and Trademark Office*